United States Patent [19]

Ehrlich et al.

[11] 4,134,556

[45] Jan. 16, 1979

[54] TIRE SHREDDER

[75] Inventors: Stanley V. Ehrlich; John T. Ehrlich, both of Portland, Oreg.

[73] Assignee: Georgia-Pacific Corporation, Portland, Oreg.

[21] Appl. No.: 834,288

[22] Filed: Sep. 19, 1977

Related U.S. Application Data

[63] Continuation-in-part of Ser. No. 665,045, Mar. 8, 1976, Pat. No. 4,052,013.

[51] Int. Cl.[2] ..... B02C 23/12

[52] U.S. Cl. ..... 241/79.3; 241/80; 241/101.2; 241/236; 241/DIG. 31

[58] Field of Search ..... 241/74, 79.3, 80, 101.2, 241/223, 236, DIG. 31; 209/236, 255, 257, 294, 297, 298, 299; 214/8.5 G

[56] References Cited

U.S. PATENT DOCUMENTS

| | | | |
|---|---|---|---|
| 1,876,150 | 9/1932 | Pearson | 209/298 |
| 2,345,937 | 4/1944 | Joa | 214/8.5 G |
| 2,628,701 | 2/1953 | Schrage | 214/8.5 G |
| 3,021,081 | 2/1962 | Leader | 209/298 |
| 3,837,490 | 9/1974 | Driebel et al. | 241/178 |
| 3,931,935 | 1/1976 | Holman | 241/74 |
| 4,052,013 | 10/1977 | Ehrlich et al. | 241/DIG. 31 |

*Primary Examiner*—Granville Y. Custer, Jr.
*Attorney, Agent, or Firm*—Klarquist, Sparkman, Campbell, Leigh, Hall & Whinston

[57] ABSTRACT

Multiple cutting discs are fixed in spaced-apart positions on each of two side-by-side counterrotating shafts so that peripheral portions of the discs on each shaft extend into the spaces between discs on the opposite shaft. Each disc has a smooth cylindrical peripheral surface which meets opposed sidewalls at sharp continuous cutting edges. The clearance between adjacent discs on opposed shafts is small so that their cutting edges coact to shear material fed into the bight between opposed counterrotating discs in their feed-through direction. Removable infeed teeth project from the peripheral surface of each disc at circumferentially spaced positions to help feed material into the bight between opposed discs. Material shredded by the discs falls onto a slowly rotating screening drum encircling the disc assembly. The smallest shredded pieces pass through such drum onto a discharge conveyor. Larger pieces are carried by inwardly extending rake-like carriers on the drum upwardly back to the infeed side of the cutting discs for reshredding into smaller pieces. A powered disc-sharpening grinder associated with the disc assembly simultaneously grinds the peripheral surfaces of all cutting discs on a shaft, after removal of their feed teeth. A lugged infeed conveyor feeds tires one at a time from a tire stack upwardly to the infeed side of the cutting disc assembly. The feeding of a tire into the disc assembly is alternated with the feeding of shredded material for reshredding so as not to overload the disc assembly.

19 Claims, 14 Drawing Figures

FIG. 9
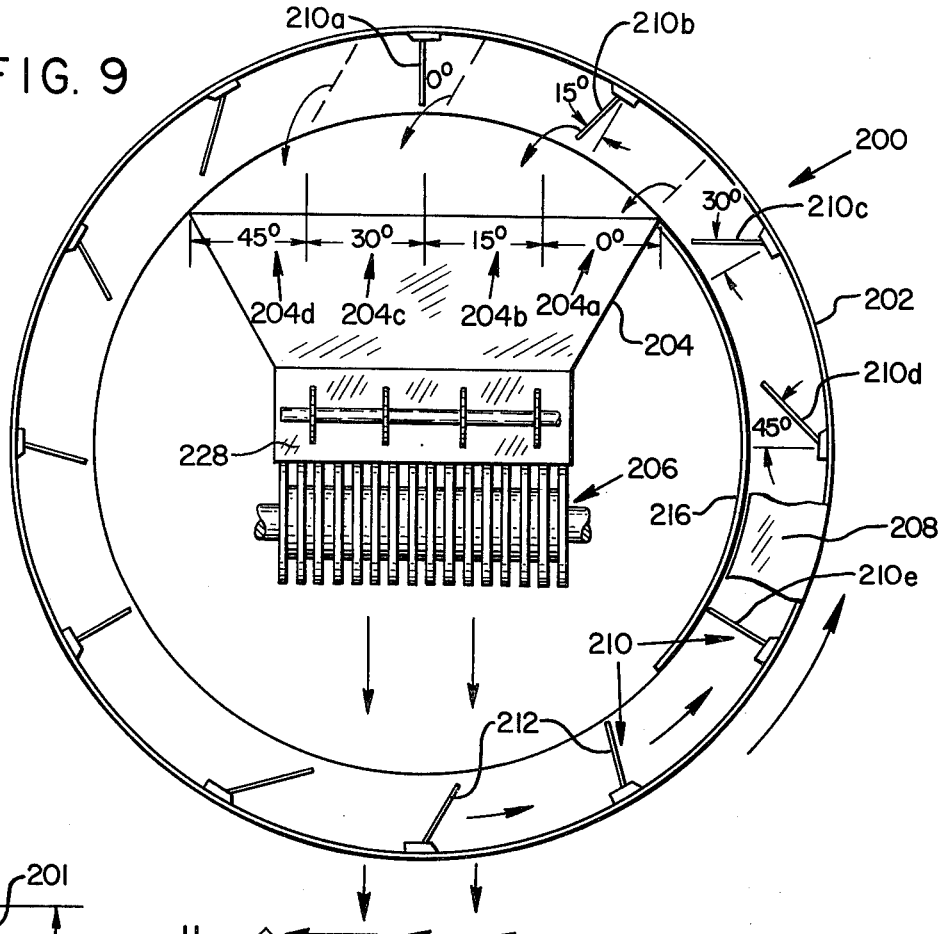
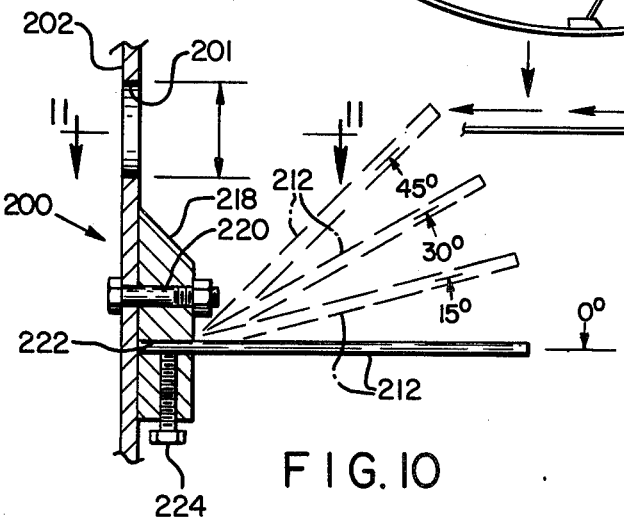
FIG. 10
FIG. 11
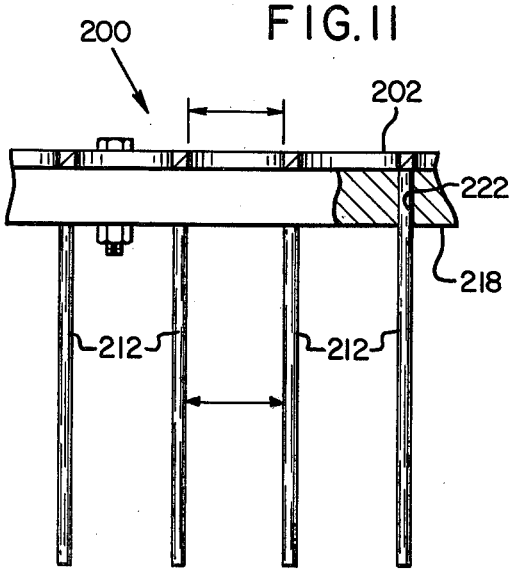

TIRE SHREDDER

RELATED APPLICATIONS

This application is a continuation-in-part of our prior copending application Ser. No. 665,045, filed Mar. 8, 1976, for Apparatus for Shredding Rubber Tires and Other Scrap Materials now U.S. Pat. No. 4,052,013, issued Oct. 4, 1977.

BACKGROUND OF THE INVENTION

1. Field of the Invention

The present invention relates to material shredders and particularly to a shredder for reducing rubber tires and similar bulk materials into small pieces.

2. Description of the Prior Art

The disposal of worn-out rubber tires is a major enrivonmental problem. When reduced to particulate form, the tires can be more readily disposed of than otherwise by using the particles either as landfill, as a constituent of paving materials, or as a source of heat energy.

Prior shredders suitable for shredding rubber tires and similar bulk scrap materials have been of two general types.

One such type, exemplified by Ehrlich U.S. Pat. No. 3,561,308, employs a series of reciprocating or oscillating knives which coact with a stationary anvil to shear a tire moving across the anvil into diamond-shaped particles. This type of tire shredder, although effective, is too slow to be economical for most commercial high-production applications, requires a complex knife-driving mechanism, and has knives which are difficult and time consuming to resharpen.

The other general type of tire shredder is characterized by opposed counterrotating drums, with each drum defining a series of axially spaced-apart cutting discs. In most shredders of this type, as exemplified by Schwarz U.S. Pat. No. 3,880,361, and Holman U.S. Pat. No. 3,931,935, the discs of one drum extend into the spaces between discs of the other drum and the discs have peripheral cutting teeth so that the overlapping discs interact to cut or tear tires into irregular pieces. The cutting teeth must be kept sharp to maintain the cutting effectiveness of the shredders. Additional shredders of this general type are shown, for example, in U.S. Pat. Nos. 3,664,592 and 3,845,907, as well as numerous patents showing similar types of apparatus in the crushing and grinding machine field.

In another counterrotating drum-type shredder, discs on one drum directly oppose discs on the opposite drum. One of each pair of opposed discs tapers to a single continuous knife edge at its outer periphery and abuts a blunt outer peripheral surface of the opposed disc. A shredder of this type is shown in Krigbaum U.S. Pat. No. 3,817,463. Material fed between the opposed discs is shred into long strips. In a modification of this concept, shown in Krigbaum U.S. Pat. No. 3,727,850, thin knife-edged discs spaced along one counterrotating drum extend into abutment with the blunt bottom surfaces of opposed grooves in the other drum to achieve a similar slicing action. In either case, it appears that a knife edge must be maintained on the cutting discs to achieve an effective cutting or slicing action. Such edge would rapidly dull in use through actual contact between the cutting elements of opposed drums, necessitating frequent resharpening and replacement of the cutting discs. Also, at least two sets of vertically stacked drums must be used, with the strips from the upper set being fed into the lower set for reshredding in order to reduce the strips to an acceptable small size.

Paper shredders have used the counterrotating drumoverlapping disc principle, as exemplified by Antonsen U.S. Pat. No. 1,939,246 and Goldhammer U.S. Pat. No. 3,630,460. The overlapping cylindrical discs of such paper shredders are typically relatively widely spaced apart so as to shred paper fed therebetween with a tearing rather than a shear-cutting action. Other paper shredders of this type have their overlapping discs in actual sliding frictional contact to cut the paper into strips, requiring considerable power to drive them. In either case, such paper shredders are typically small office machines and have not been thought applicable to the shredding of thick, tough, bulk elastic materials such as rubber tires.

The aforementioned Holman patent also discloses a tire shredder similar to the devices of the paper shredder patents in operating principle. However, the Holman shredder has no effective means for recirculating shredded scraps through the shredder to ensure that the end product is of a desired small size suitable for use as fuel chips or fill material.

From the foregoing it will be apparent that there is a need for a tire shredder capable of shredding tires into small particles at a high rate and having low and easy maintenance characteristics.

SUMMARY OF THE INVENTION

The present invention is an improved shredder of the counterrotating drum type especially suited for reducing rubber tires and similar bulk rubber and other scrap materials into small particles or chips.

A primary object of the invention is to provide a shredder especially suited for shredding rubber tires into small particles at a rapid rate.

Another primary object is to provide a shredder as aforesaid of the counterrotating drum, overlapping disc type which requires no cutting teeth on the discs and therefore eliminates the tooth-sharpening problems of prior such shredders.

Another primary object is to provide a shredder as aforesaid with a simplified form of cutting disc which can operate for long periods of time, shredding rubber tires and other tough bulk materials without resharpening and which is easily resharpened when required.

Another primary object is to provide a shredder as aforesaid with self-sharpening means for resharpening the cutting discs quickly while they remain assembled on the shredder whenever such resharpening is required.

Another primary object is to provide a shredder as aforesaid which is adaptable to reduce rubber tires and other bulk scrap materials to particles of any desired size range.

A more specific object is to provide a shredder as aforesaid capable of recirculating shredded material through the cutting disc assembly until such material is reduced to a desired size.

Another important object is to provide a shredder as aforesaid with means for facilitating the infeed of material into the cutting disc assembly for shredding.

A significant feature of the invention, in conjunction with the aforementioned self-sharpening and infeed objects, is the provision of infeed teeth on the peripheries of the cutting discs which can be readily removed from the discs to enable the peripheries of such discs to be reground by the self-sharpening means.

The shredding apparatus of the invention is characterized by a pair of side-by-side parallel generally cylindrical and counterrotatable shredding drums. Each drum defines a series of axially spaced-apart cutting discs, each having a cylindrical peripheral surface intersecting opposed sidewalls so as to define a pair of substantially continuous cutting edges. Each drum is mounted with respect to the other drum so that the discs of each drum extend into the spaces between discs of the other drum, thereby overlapping or intermeshing. The clearance between adjacent cutting edges of overlapping discs is sufficiently small so that scrap materials fed into the bight between opposing drums in a feed-through direction are cut into pieces with a shear cutting action.

At least some of the discs of each opposing drum are provided with one or more infeed teeth which project outwardly from the cylindrical peripheral surfaces of the discs to help push scrap material into the bight between the opposing drums on their infeed side during their counterrotation. The feed teeth are insert teeth which are readily removable from their cutting discs so that the discs can be readily reground to resharpen their cutting edges while remaining in place on their respective drums, using a grinding wheel assembly forming part of the shredding apparatus. The feed teeth are not intended to provide any cutting action, and in fact are preferably spaced inwardly from the cutting edges of their associated discs.

A rotatable screening drum means encircles the shredding drum assembly and receives shredded pieces of scrap discharged from the shredding drums. The screening drum slowly rotates to lift scrap material too large to pass therethrough back to the infeed side of the shredding drums for reshredding into smaller pieces. This reshredding process is repeated until the shredded pieces can pass through the screening drum onto a discharge conveyor. Rake-like carrier means on the screening drum carry the larger scrap back to the infeed portion of the shredder for reshredding, distribute such scrap along the length of the shredder, and filter smaller scrap pieces to the bottom of the screen for discharge.

The foregoing objects, features and advantages of the invention will become more apparent from the following detailed description which proceeds with reference to the accompanying drawings.

BRIEF DESCRIPTION OF THE DRAWINGS

In the drawings:

FIG. 9 is a somewhat schematic side elevational view similar to that of FIG. 4 showing a shredding drum assembly of the invention with a modified form of screening drum;

FIG. 10 is an enlarged partial circumferential sectional view through one of the carrier means of the screening drum of FIG. 9 and illustrating the varying attitudes of successive carrier means of such drum;

FIG. 11 is a partial sectional view taken along the line 11—11 of FIG. 10;

DETAILED DESCRIPTION OF A PREFERRED EMBODIMENT

Shredding Drum Assembly

With reference to FIGS. 1–4 of the drawings, the shredding apparatus of the invention includes a pair of parallel, side-by-side counterrotatable shredding drums 10, 12 supported on a heavy structural steel frame including vertical frame members 14 extending upwardly from ground level and joined at their upper ends by cross frame members 16.

Figure 2:
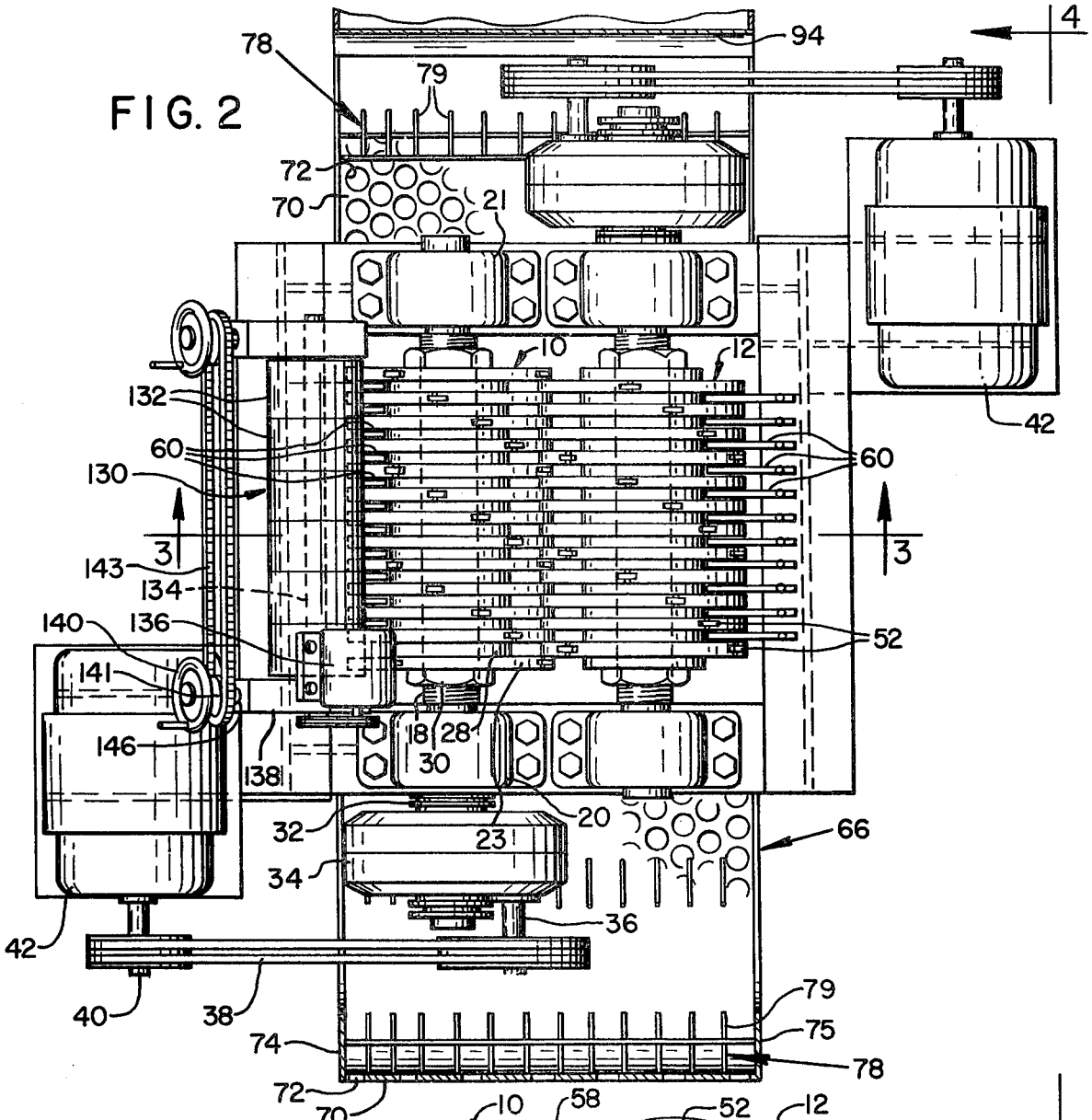
FIG. 2 is a horizontal sectional view taken approximately along line 2—2 of FIG. 1 showing the shredding portion of the apparatus in plan.
Figure 3:
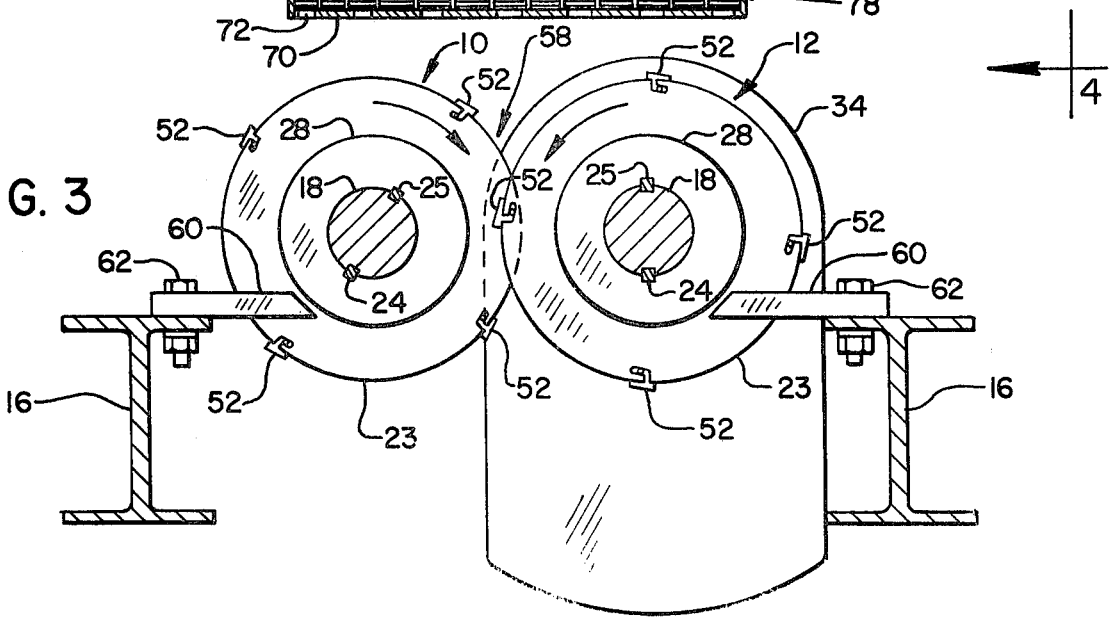
FIG. 3 is a vertical sectional view taken along the line 3—3 of FIG. 2 on an enlarged scale showing the shredding drum assembly of the apparatus.

As shown most clearly in FIGS. 2 and 3, each drum 10, 12 is composed of a central driven shaft 18 rotatably journaled at its opposite ends in bearing members 20, 21. A series of similar generally circular cylindrical cutting discs 23 are keyed to shaft 18 for rotation therewith by 180° opposed keys 24, 25. All cutting discs are of the same diameter and thickness. The cutting discs on each shaft 18 are equally spaced apart along such shaft by intermediate identical spacer discs 28 of considerably lesser diameter than cutting discs 23. The spacer discs are double-keyed to their respective shafts in the same manner as the cutting discs. The double-keyed mounting of the discs on the shafts prevents distortion of the shafts when they are subjected to high torsional loads. The discs on opposed shafts are arranged and the shafts themselves are mounted so that the cutting discs on one shaft extend partially into the gaps or spaces between cutting discs on the opposite shaft. Thus the opposed cutting discs intermesh or overlap. The spacer discs are of slightly greater thickness than the cutting discs, preferably of the order of about 0.010 thickness, so that there is a slight clearance between adjacent overlapping discs. The clearance is sufficiently small that the overlapping discs coact to cut rather than tear scrap material fed between such discs. The cutting discs and spacer discs are secured in position against axial movement on each shaft by nut members 30 threaded onto opposite end portions of each shaft.

Shredding Drum Drive

The drive means for counterrotating the shredding drums includes a separate but identical prime mover and drive train for each drum 10, 12. With reference to drum 10, its drive means includes an electric drive motor 42 carried on a motor support frame 43 extending from main frame 14. An output shaft 40 of motor 42 is connected by a belt-and-pulley drive 38 to the input shaft 36 of a torque-arm type of speed reducer 34. Speed reducer 34 has an output shaft coupled at 32 to driven shaft 18 of drum 10. The speed reducer is of a well-known type designed to disconnect its output shaft from the driven shaft when the output torque reaches a predetermined limit level.

Cutting Discs

Figure 5:
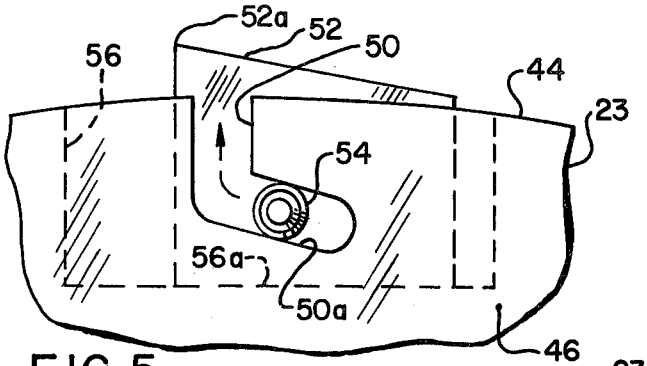
FIG. 5 is an enlarged partial side view of the one of the cutting discs of FIG. 3, showing a feed tooth on such disc.
Figure 6:
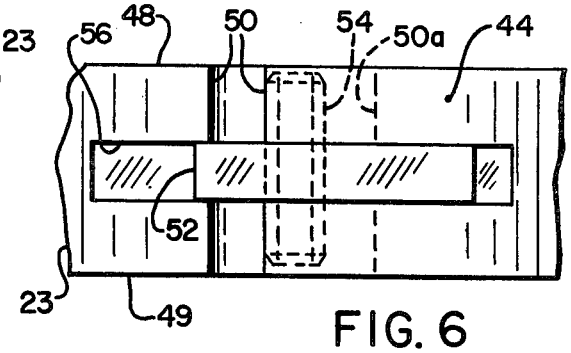
FIG. 6 is a top plan view of the cutting disc portion of FIG. 5.

Referring especially to FIGS. 3, 5 and 6, each circular cutting disc 23 has a smooth cylindrical peripheral surface 44 which meets opposed flat parallel sidewalls 46 at a pair of opposed cutting edges 48, 49. Thus the two cutting edges of each cutting disc are circular and continuous except for transverse slots 50 extending across the peripheral surface of the cutting disc at four equally circumferentially spaced positions about the disc, as shown in FIG. 3. In this sense cutting edges 48, 49 are substantially continuous.

Each transverse slot 50 intersects a narrow longitudinal recess 56 in the peripheral disc surface 44. The slot and recess cooperate to receive an insert tooth 52 and its associated retaining pin 54 which together comprise an infeed tooth means on the disc for helping force scrap material downwardly into the bight between opposed counterrotating drums in their feed-through direction of rotation. There are four such infeed teeth 52 on each cutting disc, although more or less could be used.

Each infeed tooth 52 is a generally wedge-shaped piece of tool steel having a uniform thickness dimension which is substantially less than the thickness of the cutting disc in which it is retained. Slot or recess 56 is centered between the opposite sides of the cutting disc so that the tooth 52 when inserted in the disc is spaced inwardly of cutting edges 48, 49, thereby performing no cutting function. Retaining pin 54 is a roll pin with a drill rod insert. The pin 54 is inserted through the body of tooth 52 so as to project from both sides of the tooth. Tooth and pin together are then inserted into their respective slots 56 and 50. Angular pin slot 50 has a lower leg **50*a* which extends at an inclination to the bottom surface 56*a* of tooth slot 56. Thus when infeed tooth 52 is inserted into slot 56 and forced rearwardly, pin 54 rides downwardly along leg 50*a* of slot 50, wedging tooth 52 against the bottom of slot 56. To remove tooth 52 from recess 56, the drill rod insert is tapped from pin 54 so that the pin can be pushed laterally from the tooth, after which the tooth is simply lifted from its recess. The length of pin 54 is slightly less than the thickness of disc 23** so that the ends of the pin do not protrude from the sides of the disc.

As shown in FIG. 2, the corresponding infeed teeth on all of the cutting discs of the same shaft are not axially aligned. Instead they are staggered or offset with respect to one another. In the illustrated embodiment the infeed teeth of axially adjacent discs are offset 30° from one another, always in the same direction, so that they assume a helical pattern over the entire drum. In practice this is accomplished simply by manufacturing identical discs 23 but with the keyways of each disc being offset progressively 30° in the same direction from the preceding adjacent disc. Then when the cutting discs are keyed on shaft 18, their teeth automatically are offset properly with respect to one another. Each infeed tooth 52 has a high end **52*a*** which leads its lower opposite end in the direction of rotation of the drum on which it is mounted. Since the opposed drums counterrotate, the high ends of the teeth on opposed drums confront each other, that is, they rotate toward each other in the feed-through direction of rotation of the drums.

It is emphasized that the purpose of the infeed teeth is not to aid in the cutting or shredding of material, but rather to help force material fed to the infeed side of the drums, which is the upper side in FIG. 3, into the bight 58 between the drums in their downward or feed-through direction of rotation as viewed in FIG. 3. That the infeed teeth 52 have no cutting function will be clearly apparent from FIG. 6, showing one such tooth displaced laterally inwardly a substantial distance from cutting edges 48, 49 of its associated cutting disc 23.

A series of stripping fingers 60, shown in FIGS. 2 and 3, extend into the spaces between cutting discs of each drum and terminate near the outer peripheries of spacer discs 28 and near the sidewalls of the adjacent cutting discs. Such fingers strip shredded material wedged between cutting discs out from between such discs as they rotate, forcing it downwardly from the drum assembly. The stripping fingers are bolted at 62 near their outer ends to upper flange portions of cross frame members 16 of the shredder assembly.

Screening Drum

Encircling the entire shredding drum assembly in a substantially vertical plane is a screening means comprising a generally cylindrical rotatable screening drum 66. The slowly rotating screening drum receives shredded material discharged from the outfeed or underside of shredding drum assembly 10, 12 and passes the smaller shredded pieces through its foraminous outer wall 70 onto a discharge conveyor 68. Larger shredded pieces are carried upwardly and back to the upper infeed side of the shredding drum assembly to be reshredded into smaller pieces which will pass through the screening drum to discharge conveyor 68.

The foraminous outer cylindrical wall 70 of screening drum 66 has openings 72 of a size selected so as to pass material of the maximum particle size desired to be produced by the shredder. Opposite annular sidewalls 74, 75 extend radially inwardly from the outer foraminous wall 70 to form with the outer wall a sort of annular trough for containing shredded material which does not pass through the outer wall. The trough is subdivided circumferentially into equal trough sections indicated generally at 76 in FIG. 4 by a series of generally radially extending carrier means or trough partitions 78. Trough partitions 78 are formed of an open grating or rake-like structure and include tines 79 (FIG. 2) which extend radially inwardly from outer wall 70 and terminate at their inner ends in alignment with trough sidewalls 74, 75. These rake-like grating partitions serve as carrier means to lift shredded strips of material upwardly to the infeed side of the shredding drum assembly for reshredding as the screening drum slowly rotates. At the same time such partitions permit smaller pieces of shredded material to sift or filter downwardly through the partitions to the bottom of the screening drum and eventually through its outer wall to the discharge conveyor.

A retaining means or shield is provided to prevent shredded materials from falling from the inwardly open trough sections as they move upwardly and generally vertically and then toward an upsidedown or dumping position directly over the shredding drum assembly. Such retaining means is needed because the screening drum is rotated at such slow speeds that centrifugal force cannot be relied on to retain the scrap on the drum as it rotates. The use of centrifugal force for this purpose would not be desirable because it would interfere with the screening or filtering action of the drum and carrier tines. Such retaining means, shown most clearly in FIG. 4, includes a stationary curved shield wall 94 extending along and across a generally vertically extending and upwardly moving portion of screening drum 66 closely adjacent to the radially innermost open side of the trough. The shield wall is rigidly connected to an infeed hopper 98 and by such hopper and support members 96 to the main frame of the machine. Additional supports 97 also help support the infeed hopper structure 98 on such frame. The trough sections of the screening drum dump their loads into such hopper as they rotate toward upsidedown positions. Two of the guide walls of such hopper are shown at 99, 100 in FIG. 4.

Figure 4:
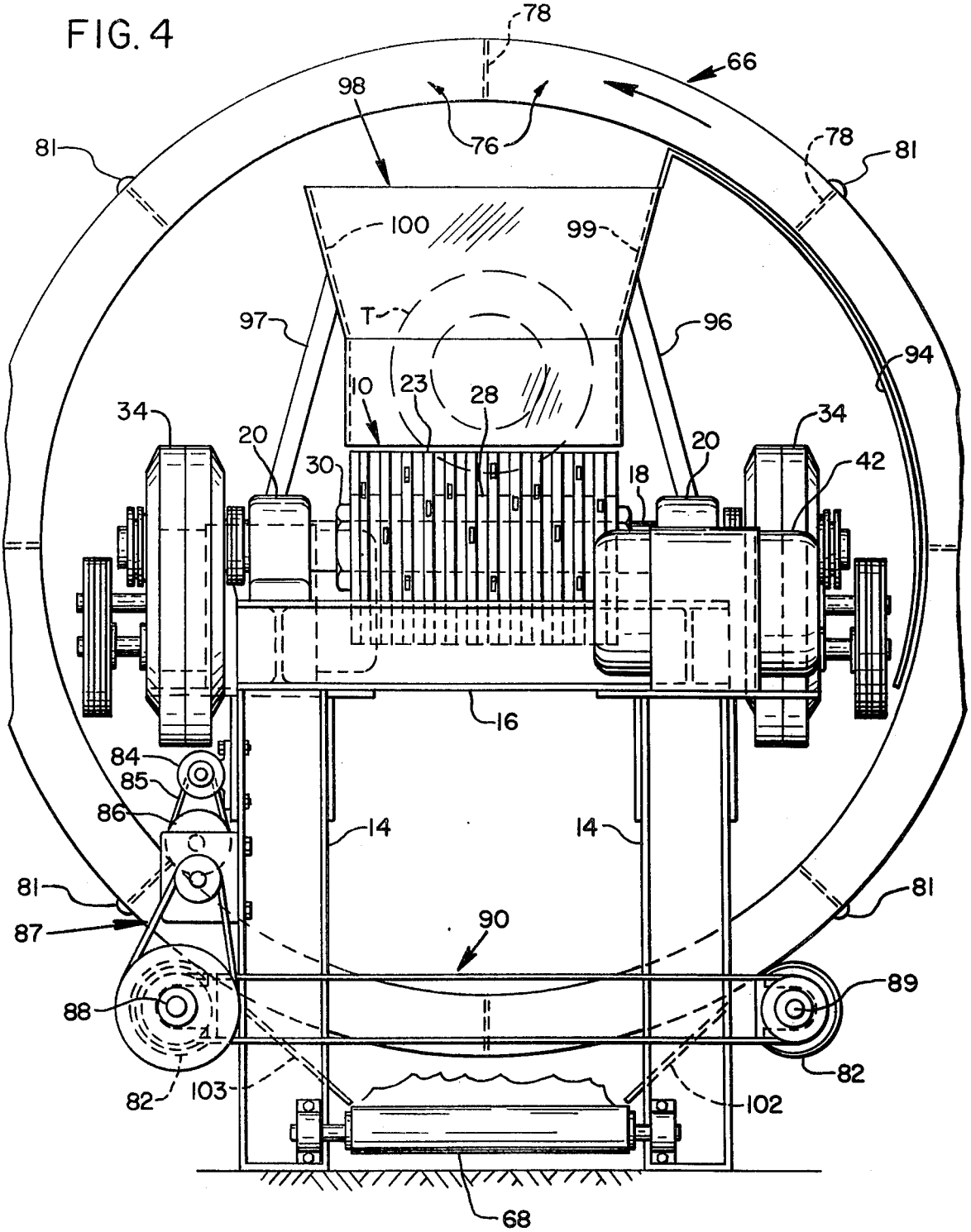
FIG. 4 is a side elevational view of the major portion of the apparatus.

Additional guide members, also shown in FIG. 4, define guide walls 102, 103 of a discharge chute for guiding shredded material passing through the screening drum onto the belt of discharge conveyor 68. Chute walls 102, 103 are affixed to upright frame members 14.

FIGS. 9–13 illustrate a modified form of screening drum and infeed hopper assembly which provides an improved infeeding action for both whole rubber tires and shredded scrap material recirculated to the infeed hopper by the screening drum.

In FIG. 9 the screening drum 200 has a foraminous outer cylindrical wall 202 as before in surrounding relationship to an infeed hopper 204 which feeds scrap material in strip or chip form to be shredded or reshredded to the upper infeed side of a shredding drum assembly 206 as previously described.

Screening drum 200, like the previously described screening drum, has annular opposite sidewalls 208 extending inwardly from cylindrical outer wall 202 to define a trough-like structure for receiving via gravity shredded scrap material from the shredding drum assembly 206. Also as before, the screening drum 200 has its trough circumferentially subdivided into trough sections by rake-like carrier means or partitions shown generally at 210 to carry the shredded scrap deposited on the screening drum upwardly in a counterclockwise direction of rotation as shown in FIG. 9 and back to the infeed side of the shredding drum assembly over the infeed hopper 204.

Each rake-like carrier partition 210 is composed of a series of laterally aligned and spaced parallel tines 212 extending in a row across the width of outer wall 202 and extending generally inwardly toward the central area of the drum from such outer wall. The tines 212 of each carrier 210 are spaced apart a distance corresponding approximately to the size of the openings 201 (FIG. 10) in the outer wall of the screening drum. Thus, for example, if the diameter of the holes through the screening drum outer wall is 2½ inches, the spacing between tines in each carrier member is also preferably about 2½ inches.

Also, as previously mentioned, the rotation of the screening drum is preferably at a sufficiently slow rate of speed that centrifugal force does not operate to hold the recirculating scrap against the inner surface of outer wall 202 as the screening drum rotates. This absence of centrifugal force enables the tines and openings in the outer wall 202 of the screening drum to cooperate in providing a sifting, filtering and screening action to ensure that only oversized pieces or chips of scrap are carried upwardly and back to the infeed hopper for reshredding, thus promoting efficiency, accurate sizing of scrap chips, and optimum production without overloading the shredding drums.

With the screening drum slowly rotating, scrap from the shredding drum assembly received at the bottom of the screening drum is moved gradually upwardly on the outer wall of the drum in a counterclockwise direction. As the shredded scrap moves upwardly, it tends to tumble downwardly under the influence of gravity, coming to rest against tines 212 of the lower adjacent carrier 210. Small pieces of shredded scrap pass downwardly between the tines of such carrier and continue downwardly to the next lower carrier through which it will also pass, eventually reaching the bottom region of the screening drum where the smaller particles eventually pass through the outer wall onto an outfeed conveyor illustrated schematically at 214 in FIG. 9.

However, the oversized shredded pieces will be lifted by the tines 212 of each carrier against which they rest upwardly in the direction of rotation of the screening drum until they pass infeed hopper 204, where gravity causes them to drop from the tines into the hopper for reshredding. A shield wall 216 is used as before along the inner circumference of the upwardly traveling portion of the screening drum to prevent premature release of the upwardly moving scrap from the tines.

Generally, the range of rim speeds suitable to achieve the desired screening effect described can vary between about 40 and 480 lineal feet per minute, with the exact speed selected depending on the scrap chip size required, the density of material being shredded, the capacity of the shredding drums and screen, and the production speed described. Also a factor is the speed of the tire infeed conveyor and the desired correlation between tire infeed and scrap chip infeed to the shredding drums.

In the screening drum embodiment of FIG. 9, all of the tines of one carrier are parallel to one another and extend inwardly toward the central portion of the drum at the same radial angle, that is, at the same angle to a radius extending through the base of the carrier tines. However, the tines of adjacent carriers extend inwardly at different radial angles, as will be apparent from FIGS. 9 and 10. The radial angles of the tines of the various carriers range from about 0° to 45° with the radial angle of each successive carrier proceeding in a counterclockwise direction in FIG. 9 increasing in 15° increments. Thus, referring to FIG. 9, the topmost carrier **210*a* has its tines extending at a 0° radial angle whereas the next-successive carriers 210*b*, 210*c*, 210*d* extend at radial angles of 15°, 30°, and 45°, respectively. The next-successive carrier 210*e*** starts the cycle over again extending at a 0° radial angle.

As a result, the tines extending at a 0° radial angle deposit scrap in the region **204*a* of the infeed hopper, whereas the tines at a 15° angle deposit scrap in the region 204*b* of the hopper. The 30° tines deposit their scrap in the 204*c* region of the hopper, and the 45° tines deposit their scrap in the region 204*d* of the hopper. Thus the purpose of varying the radial angle of the tines of successive carriers is to distribute successive loads of scrap to be reshredded to different portions of the length of hopper 204 to prevent overloading any one portion of shredding drum assembly 206** and to enable reshredded scrap to be delivered to the infeed hopper at the same time that whole tires or other bulk scrap material is fed into the infeed hopper by a separate infeed conveyor device, if desired.

Although a particular sequence of radial angles is disclosed for distributing the load from the tines, any other sequence could be used so long as the tines of one carrier have a radial angle that differs from that of the tines of the adjacent carrier whereby the load will be distributed throughout the length of the hopper. In general, however, it has been found in practice that the radial angles used should range from about 0° to 45° for the configuration of hopper and relationship of hopper and screening drum shown. Any radial angle greater than 45° will tend to carry the scrap over and beyond the hopper, unless the hopper itself is modified accordingly.

FIGS. 10 and 11 illustrate the manner in which tines 212 of each carrier are mounted on the screening drum. A metal mounting bar 218 forms the base of each carrier and extends across the width of the screening drum. The bar is anchored to the outer wall 202 of the drum by a bolt assembly 220. Mounting holes 222 are drilled through the bar at spaced intervals along its length corresponding to the desired spacing of the tines 212 and sized so as to snugly receive the tines which may be formed of steel rod. Set screws 224 threaded through one side of mounting bar 218 secure each tine 212 in its desired position. The angle at which the mounting hole 222 is bored into the face of mounting bar 218 determines the radial angle of the tines.

Figure 12:
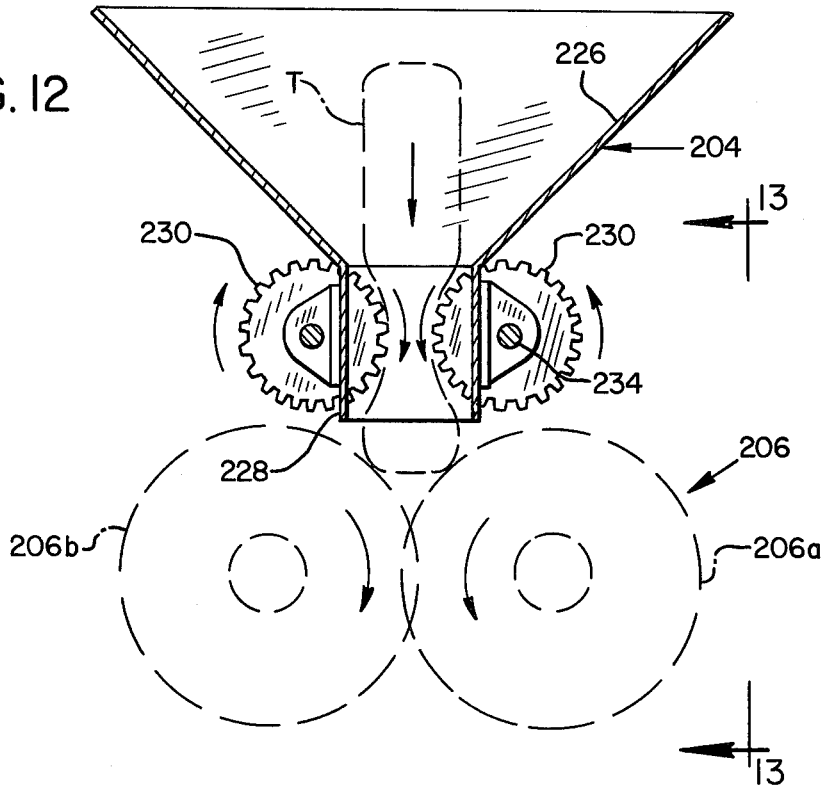
FIG. 12 is a sectional view through a modified infeed hopper portion of the shredding drum assembly shown in FIGS. 1–4.
Figure 13:
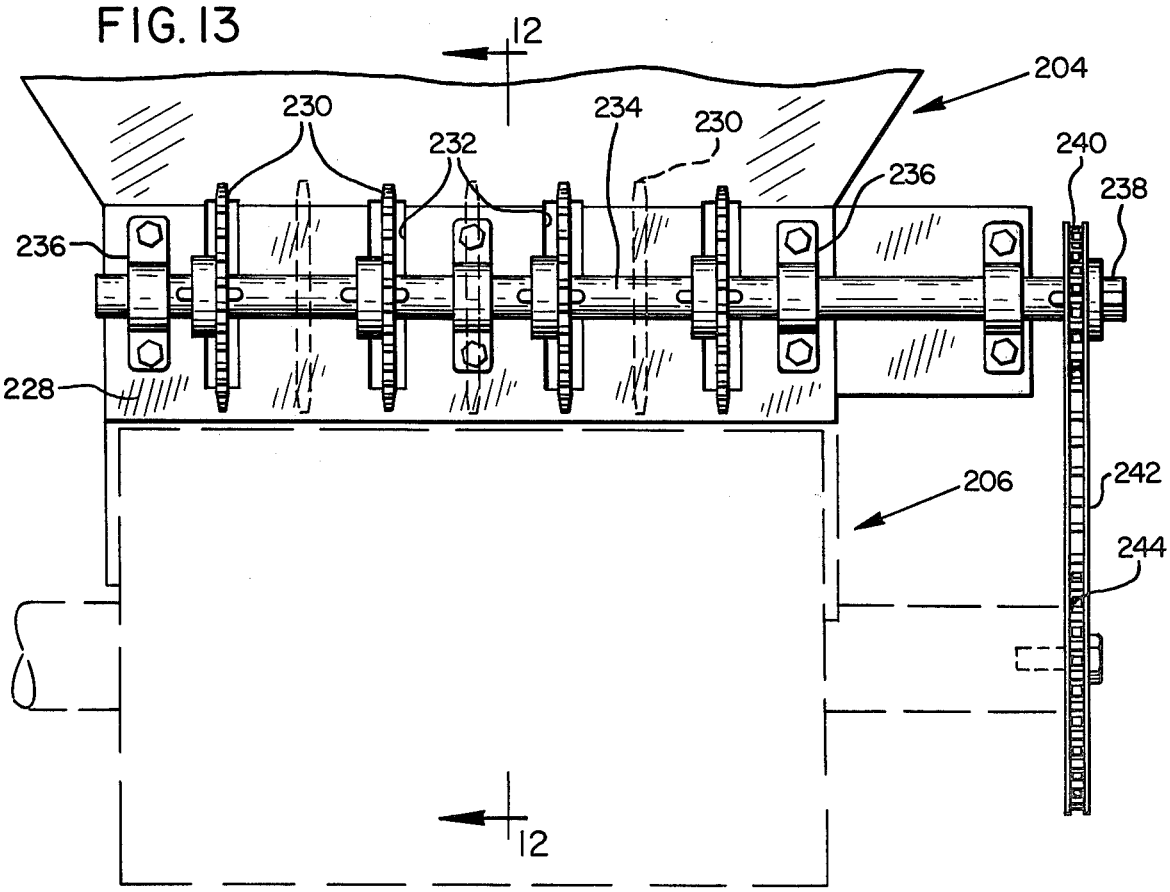
FIG. 13 is an enlarged partial side elevational view of the hopper portion of FIG. 12 as viewed from the line 13—13 of FIG. 12.

FIGS. 12 and 13 illustrate the infeed hopper 204 of FIG. 9 in greater detail. Hopper 204 includes an upper converging chute portion 226 with inclined opposite sidewalls converging toward a vertically downwardly extending throat portion 228 centered over and between the opposed shredding drums 206*a*, 206*b*. Sprocket-like infeed wheels 230 extend through slots 232 in the opposite sidewalls of throat portion 228 and into the interior of the throat. In the illustrated embodiment of FIGS. 12 and 13, four infeed wheels 230 are provided on one side of the throat at equally spaced intervals along its length. Three infeed wheels 230 are provided on the opposite side of the throat, in staggered relationship to the wheels 230 on the one side of the throat, as will be apparent from FIG. 13. The wheels 230 on each side of the throat are mounted on a common shaft 234 rotatably secured in bearing brackets 236 at opposite ends of the throat. A shaft extension 238 carries a sprocket 240 which receives a drive chain 242 receiving power from a drive sprocket 244 for the shredding drum drive.

As will be apparent from FIG. 12, the infeed wheels 230 on opposite sides of the throat rotate in opposite directions in a manner to grip and collapse and drive a rubber tire T downwardly through throat 228, thereby forcing it downwardly between the pair of shredding drums 206*a*, 206*b*. The use of such wheels thus greatly enhances the feeding characteristics of the hopper.

Screening Drum Drive

Figure 1:
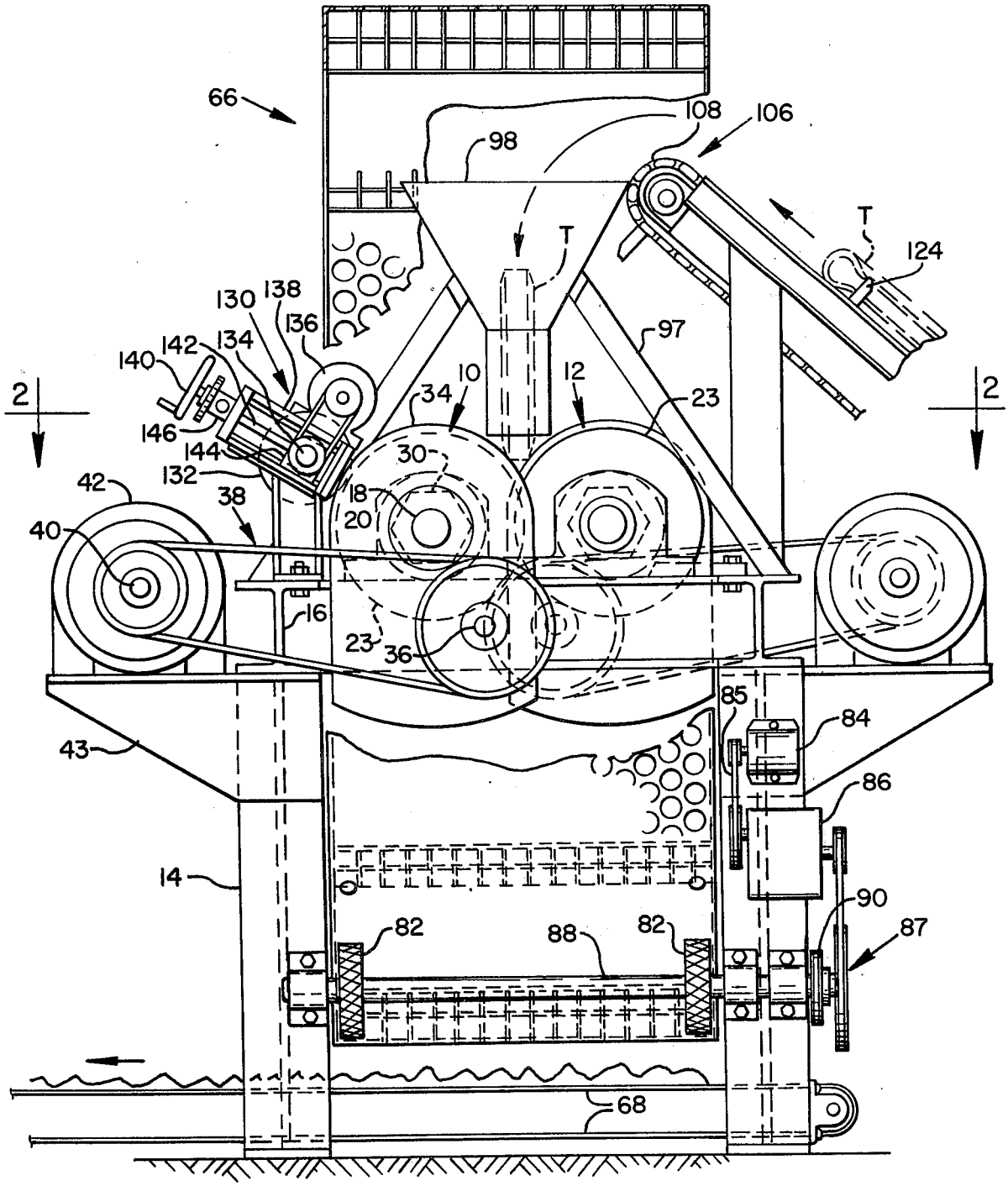
FIG. 1 is a front elevational view of the major shredding portion of a shredding apparatus in accordance with the invention.

Screening drum 66 is supported on opposed pairs of rubber pneumatic-tired wheels 82. The wheels are driven so as also to function as part of the drive means for rotating such drum. Referring to FIGS. 1 and 4, drive wheels 82 are driven by a variable speed drive motor 84. Such motor transmits power to the wheels through a belt-and-pulley drive 85, a speed reducer 86, a second belt-and-pulley drive 87 and an extension of a driven shaft 88 mounting the one pair of drive wheels 82. The second pair of drive wheels 82 on the opposite side of the lower end of the screening drum are fixed to a second shaft 89 (FIG. 4) driven through a belt-and-pulley drive 90 from the extension of shaft 88.

As the described drive means drives the wheels 82, they frictionally engage the undersurface of outer wall 70 of the screening drum to rotate such drum slowly in a counterclockwise direction as viewed in FIG. 4. Shake bumps 81 on the outside of wall 70 periodically pass over the wheels, shaking the screening drum to deposit a load into infeed hopper 98. Such bumps also help small particles to pass downwardly through the rake- or comb-like partitions 78 and through the outer wall of the drum itself.

Tire Infeed

Figure 7:
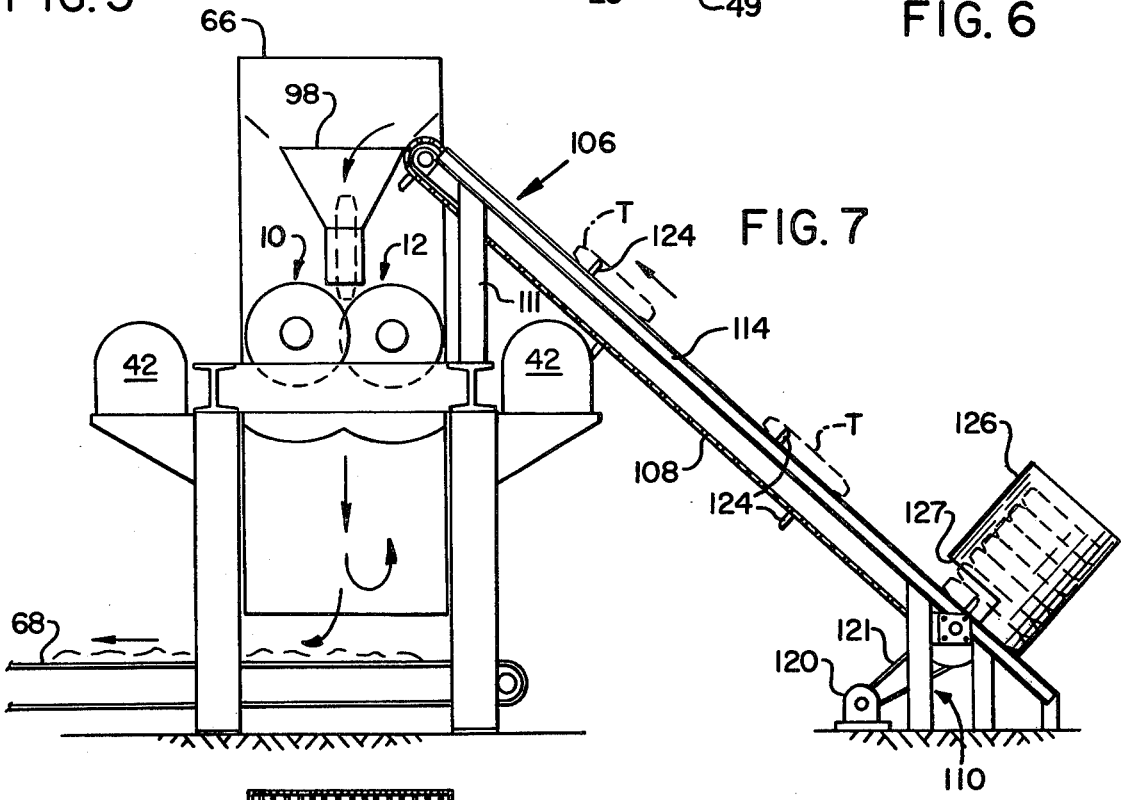
FIG. 7 is a somewhat schematic elevational view of the shredding apparatus including an infeed conveyor portion thereof.
Figure 8:
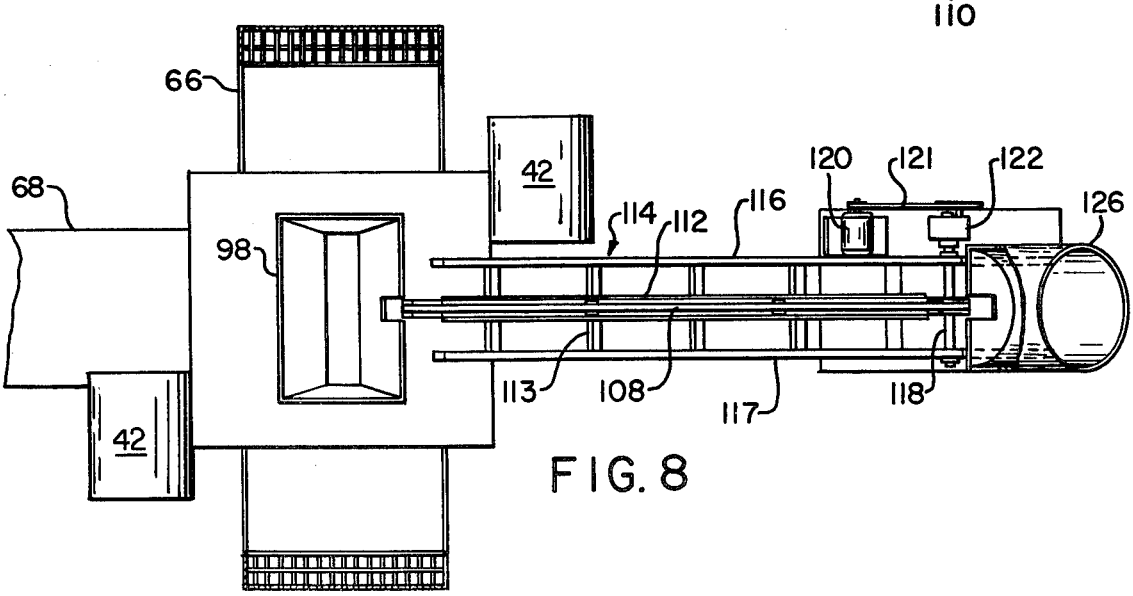
FIG. 8 is a somewhat schematic top plan view of the apparatus of FIG. 7.

Infeed conveyor means are also provided for delivering bulk rubber scrap into the infeed chute 98. Such infeed conveyor means, the upper end of which is shown generally at 106 in FIG. 1 and more completely in FIGS. 7 and 8, includes a lugged endless infeed conveyor chain 108 extending in an upward inclination from a lower infeed end near ground level to an upper outfeed end terminating adjacent to the upper end opening of infeed hopper 98. Infeed chain 108 has an upper run which travels along a center guideway 112 supported by cross frame members 113 of a conveyor support frame 114. Conveyor frame 114 has longitudinally extending opposite side rail members 116, 117 interconnected by cross frame members 113. The conveyor frame is supported at its lower end by ground level supports 110 and at its upper end by supports 111 connected to a main frame member 16 of the machine. The conveyor chain is trained about shaft-mounted sprockets at its opposite ends, the sprocket shafts being journaled in bearings carried by frame 114. The sprocket shaft 118 at the lower end of frame 114 is driven by a variable speed conveyor drive means including a drive motor 120, belt-and-pulley drive 121, and speed reducer 122, all as shown most clearly in FIG. 8.

Conveyor chain 108 has lugs 124 at equally spaced intervals along its length. A tire magazine 126 for containing a stack of tires T is mounted over the lower end of infeed conveyor frame 114 in a position such that each lug 124 enters the center opening of the lowermost tire T of the stack of tires in the magazine as it travels about the upwardly traveling lower end run of the conveyor chain. The magazine has a forwardly directed lower end opening 127. Thus each lug 124 drags the lowermost tire from the magazine forwardly onto the upper run of conveyor chain 108 and upwardly along side rails 116, 117, to the infeed hopper 98. At the upper end of the conveyor, the lug 124 flips its tire T vertically into hopper 98 as the lug travels about the downwardly traveling upper end run of the conveyor chain, thereby orienting the tire for proper guiding through the hopper into the bight between the shredding drums.

As previously indicated, both the drive means for screening drum 66 and the drive means for tire infeed conveyor 106 are variable speed drives. This enables desired coordination of the delivery of tires and shredded material for reshredding into the infeed hopper 98 so that the hopper and the shredding drums do not become overloaded. Preferably the delivery of shredded material and a tire to the infeed hopper is synchronized so that material for reshredding and tires are fed to the hopper alternately. More specifically, a trough section of the screening drum dumps its load, followed by the delivery of a single tire, then followed again by a load from the next trough section, in sequence.

Self-Sharpening Means

The shredding apparatus is also provided with a self-sharpening means for maintaining the cutting edges 48, 49 of the cutting discs 23 in cutting condition. The self-sharpening means, indicated generally at 130 in FIGS. 1 and 2, comprises a series of grinding wheel segments 132 fixed in side-by-side relationship on a driven shaft 134 adjacent to one of the shredding drums 10. A similar grinding wheel means is preferably mounted adjacent to the other drum 12, although not shown in FIGS. 1 and 2. Each grinding wheel assembly extends the full length of its associated drum so that all cutting discs on a drum can be ground simultaneously.

Grinding wheel shaft 134 is driven through a belt-and-pulley drive from an electric motor 136 mounted on a grinder support frame 138 at one end of the grinder assembly.

Grinder shaft 134 is mounted for in-and-out movement toward and away from the cylindrical peripheral surfaces of the cutting discs 23 on shredding drum 10 to move the grinding wheel segments into and out of contact with the drum. The means for effecting such in-and-out movement includes a hand wheel 140 which turns a screw shaft 142 threaded into a nut member 144. Nut member 144 is mounted for sliding movement along a slideway of frame 138 and carries one end of grinding wheel shaft 134. A similar nut member slidable in a similar frame carries the opposite end of shaft 134. Axial movement of screw shaft 142 is prevented by a mounting collar 146 on the screw shaft. Thus, when wheel 140 is turned, it rotates screw shaft 142, causing in-and-out movement of nut member 144 and its connected shaft 134 carrying the grinding wheel segments. A sprocket 141 is connected by a chain 143 to an identical screw shaft and nut type drive assembly at the other end of the grinding wheel so that the in-and-out motion induced at either end of the grinding wheel shaft 134 is also transmitted to the opposite end of such shaft for uniform and simultaneous movement of the entire shaft and grinding wheel assembly.

Although a manually operated feed for the grinding wheel is shown, in practice the grinding wheel could also be provided with an automatic feed, the details of which are shown and described, for example, in U.S. Pat. No. 3,633,833. Also as suggested in such prior patent, the grinder could be driven from one of the drive shafts or driven shafts for the shredding drums through an appropriate belt-and-pulley or chain-and-sprocket drive means.

The self-sharpening means as described is not used during the normal operation of the shredding drums to shred tires and other material, nor is it desirable to do so because of the presence of the infeed teeth 52 on the cutting discs of such drums. Instead, the self-sharpening means is only used when the cutting edges of the cutting discs require resharpening. In such instances the infeed teeth are first removed from the cutting discs before the peripheral surfaces of the cutting discs are ground.

It is most convenient to provide a separate grinding wheel assembly for each of the two shredding drums 10, 12. However, because it is expected that the cutting discs will only need to be reground infrequently, and because the grinding wheel assembly itself is self-contained, it is possible if desired to provide only one grinding wheel assembly for the shredder. In such case, the grinder would be transferred from one side of the shredder frame to the other where it would be positioned alongside drums 12 to grind the cutting discs on such drum after grinding the cutting discs on drum 10.

Overall Drive and Control System

Figure 14:
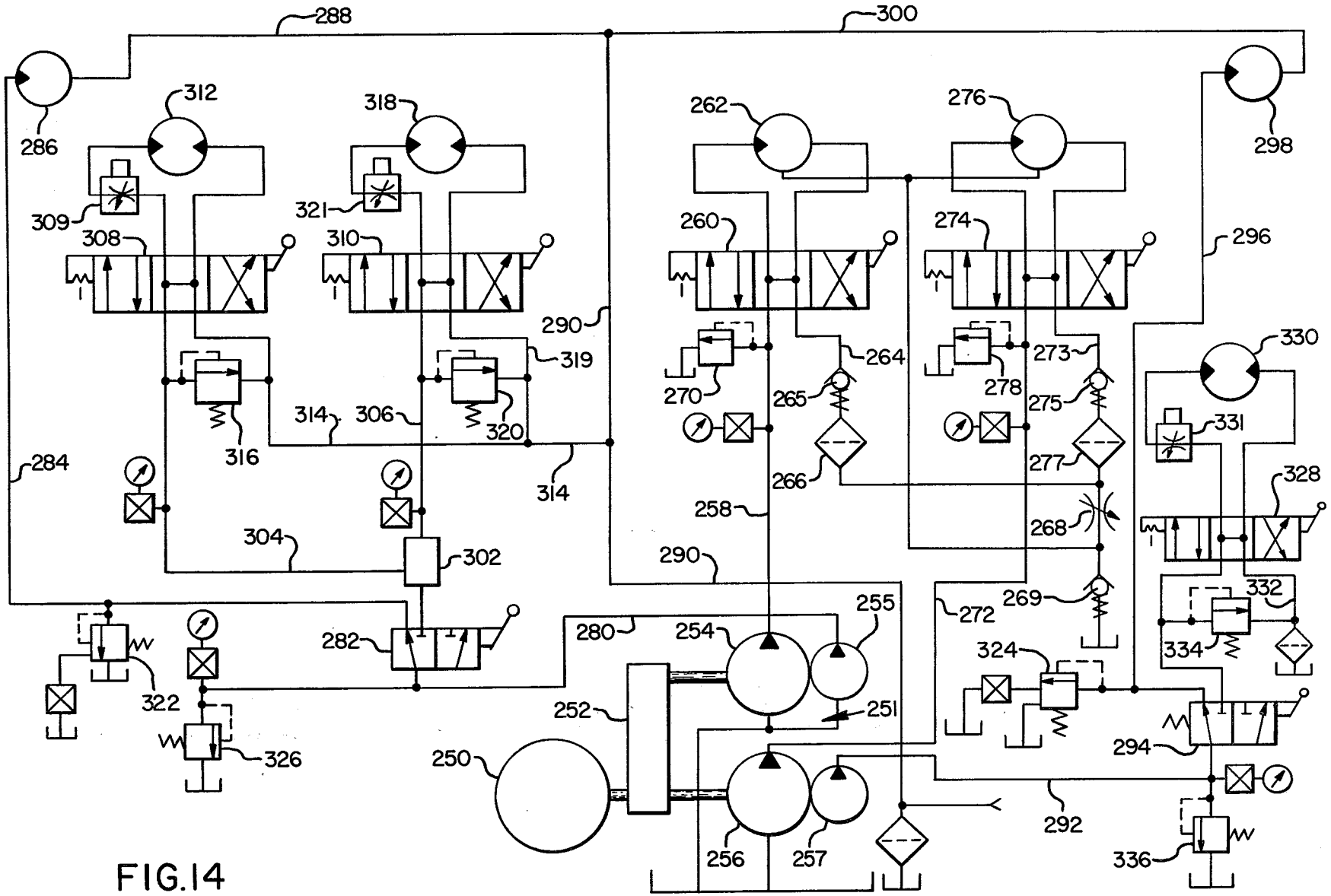
FIG. 14 is a hydraulic circuit diagram of the drive and control system for the shredder of FIGS. 1–8 and modifications thereof.

FIG. 14 discloses a typical control system for driving the shredder and its various components hydraulically, rather than primarily mechanically as illustrated with respect to FIGS. 1–9. In the hydraulic drive and control system, a diesel or other suitable engine 250 drives two sets of dual hydraulic pumps 251 through a suitable mechanical transmission 252. Such pump sets include a first set having a main pump 254 and smaller capacity auxiliary pump 255. The second set is identical and includes a main pump 256 and auxiliary pump 257.

Main pump 254 supplies fluid under operating pressure through a supply line 258 to a three-position, four-way spool valve 260. Valve 260, through manual operation, selectively directs fluid to one of the opposite sides of a reversible hydraulic motor 262 which drives one of the two shredder drums 10, 12. A return line 264 directs exhaust fluid from motor 262 back to sump from control valve 260 through check valve 265, filter 266, variable orifice 268, and check valve 269. A pressure relief valve 270 in supply line 258 relieves circuit pressure when it reaches an abnormally high level, such as when the shredder drums might become jammed.

Similarly, main pump 256 supplies fluid under operating pressure through a supply line 272 to a three-position, four-way manually operated spool valve 274, which in turn directs the pressure fluid selectively to one of the opposite sides of a reversible hydraulic motor 276 for driving the other one of the pair of shredding drums 10, 12. A return line 273 leads exhaust fluid from the motor 276 and valve 274 back to reservoir through a check valve 275, filter 277, and the previously mentioned variable orifice 268 and check valve 269. Supply line 272 is provided with a pressure relief valve 278 which has a function similar to that of pressure relief valve 270 in the circuit of hydraulic motor 276. The speed of the shredder drum drive motors 262, 276 is controlled by varying the speed of engine 250.

Auxiliary pump 255 in the first pump set delivers pressure fluid through a supply line 280 to a two-position manually operated selector valve 282. In the position shown, selector valve 282 delivers pressure fluid through a line 284 to a nonreversible hydraulic motor 286 for driving one of a pair of grinding wheels 130 (FIG. 2). Exhaust fluid from motor 286 is returned to sump through return lines 288, 290.

Auxiliary pump 257 of the second pump set delivers fluid under a predetermined operating pressure through a supply line 292 to a two-position, manually operated selector valve 294 which in the position shown delivers fluid through a line 296 to a nonreversible hydraulic motor 298 for driving the other grinding wheel (not shown) when two grinding wheels are used, one for each shredding drum. Exhaust fluid from motor 298 is returned to sump through a return line 300 and previously mentioned return line 290.

In the other position of selector valve 282, pressure fluid from pump 255 is delivered to a flow divider 302 and from there through supply lines 304 and 306 to a pair of three-position, four-way manually operated spool valves 308, 310, respectively. Spool valve 308 delivers pressure fluid selectively to one of the opposite sides of a reversible hydraulic motor 312 which drives the discharge conveyor 68 of FIG. 4 or 214 of FIG. 9. Exhaust fluid from motor 312 is returned to sump from valve 308 through a return line 314 and return line 290. The circuit for motor 312 is also provided with a pressure relief valve 316 to relieve the system of excess pressure. A manually operated flow control valve 309 in the primary supply line between spool valve 308 and motor 312 controls the speed of the discharge conveyor.

Control valve 310 selectively directs pressure fluid to one of the opposite sides of a hydraulic motor 318 for driving the rotatable screening drum 200 of FIG. 9 or 66 of FIG. 4. Exhaust fluid from motor 318 is returned to sump from valve 310 through a return line 319 and previously mentioned return lines 314, 290. The circuit for motor 318 also has a pressure relief valve 320. Such circuit, between spool valve 310 and motor 318 also includes a manually operated flow control valve 321 to control the speed of the screening drum.

The circuits for the grinder motors 286 and 298 are also provided with pressure relief valves 322, 324, respectively. Another pressure relief 326 is provided in supply line 280 in parallel with selector valve 282.

When selector valve 294 is in its second position not shown in FIG. 14, pressure fluid from pump 257 and supply line 292 is directed through the valve 294 to a three-position, four-way manually operated spool valve 328. Control valve 328 selectively directs pressure fluid to one of the opposite sides of a reversible hydraulic motor 330 for driving the infeed conveyor 106 shown in FIG. 7. Exhaust fluid from motor 330 is returned to sump through a return line 332 from valve 328. A pressure relief valve 334 is provided in the circuit for motor 330 to protect the circuit from excessively high pressures. The speed of infeed conveyor motor 330, and thus the conveyor itself, is controlled by a manually operated flow control valve 331 in the motor circuit between spool valve 328 and motor 330.

A pressure relief valve 336 is provided in supply line 292 in parallel with selector valve 294, which protects the system from excessively high pressures.

With a hyraulic system as shown, the shredding drums can be driven either while the grinder motors 286 and 298 are operated and the various conveyors remain inactive, or alternatively while the discharge conveyor, screening drum and infeed conveyor motors 312, 318 and 330, respectively, are operated, depending on the positions of selector valves 282 and 294. Furthermore, the shredder drums can be operated by their motors 262 and 276 without operating either the grinder motors 286, 298 or the infeed and discharge conveyor motors and screening drum motor by placing control valves 308, 310 and 328 in their neutral positions with selector valves 282 and 294 positioned for directing fluid to these valves. It will also be evident that each of the motors 312, 318 and 330 can be operated independently of each other through appropriate positioning of their respective control valves. Furthermore, the feed speeds of the infeed, discharge and rotating screen conveyors can be controlled independently through manipulation of their respective flow control valves. In this way, the infeed of tires to the shredding drums can be correlated with the infeed of scrap chips for reshredding, so that tires and chips can be shredded either simultaneously or alternately as desired.

Example

The following are dimensions and specifications for a typical stationary shredder as described suitable for shredding tires.

The clearance between overlapping cutting discs is important. Too much clearance causes the discs to tear rather than shear material, which in the case of tires could cause an overloading of the drive elements. Too little clearance causes frictional contact between the discs and therefore undue wear and high power requirements. For most tire-shredding applications, it is expected that the preferred clearance between adjacent overlapping cutting discs will be of the order of 0.004 to 0.007 inches.

A typical drum suitable for shredding tires has a shaft diameter of 5-9/16 inches, a cutting disc diameter of 24 inches, a cutting disc thickness of 1⅜ inches and an overall effective length of about 34⅜ inches. The overlap of opposed cutting discs is at least about ½ inch up to about 2 inches. The diameter of the spacer discs is about 14 inches. The thickness of the spacers is 1⅜ inches plus about 8 to 12 one-thousandsths of an inch to give the desired clearance between adjacent overlapping cutting discs.

At a speed of 22 revolutions per minute, it is estimated that the cutting discs will shred about 1,000 tires per hour, and with faster speeds up to 1,700 tires per hour. The typical screening drum has a 130 inch outside diameter and a 114 inch inside diameter at the inner circumference of the trough. It rotates at one to two revolutions per minute, giving it a rim speed of approximately 40 to 50 feet per minute. The openings in the screening drum are approximately 3 inches in diameter to produce particles in a size range suitable for use as boiler fuel. The pneumatic-tired wheels which support and drive the screening drum typically have a 12 inch diameter.

A typical drive motor for each shredding drum is electrical and rated at 50 horsepower and 900 rpm. A suitable speed reducer for the drums is a Dodge torque arm double reduction speed reducer - Series TDT-1024 having a reduction ratio of 24.3:1. The drive means for the tire infeed conveyor is designed to move the conveyor chain at 83-1/3 feet per minute or 1,000 lugs per hour at a typical 60 inch spacing between lugs. The speed reducer for the infeed conveyor could typically be a Dodge torque arm reducer - series TDT-315 having a 15:1 reduction ratio.

As for the self-sharpening means, the grinding wheel segments are typically 12 inches in diameter and 6 inches wide.

Each infeed tooth for the typical cutting discs described has an overall length of 1.875 inches, a maximum height of 1.25 inches, and a 10° slope from the leading end rearwardly along its top surface. The thickness of each tooth is 0.375 inches and the roll pin is ⅜ inch in diameter and 1.25 inches long.

Alternative Embodiments and Features

Rather than being stationarily mounted as shown, the shredder can be trailer-mounted and thereby made portable. In portable shredders, the primary drive would preferably be diesel-electric or diesel-hydraulic. A diesel engine mounted on the trailer would drive an electric generator or hydraulic pumps which in turn would drive electric or hydraulic motors to drive the shredding drums, screening drum, infeed conveyor and grinding wheels. A diesel fuel supply would also be carried on the trailer. The infeed conveyor would be constructed so as to fold for travel. The screening drum would also be capable of disassembly into half sections for travel.

Alternative forms of infeed tooth means other than insert teeth 52 may also be provided as feed means on the cutting discs. For example, insert teeth 52 could be replaced with other removable projections or lugs serving as infeed tooth means. Simple cap screws could serve this purpose. Tapped holes would be provided at intervals along the centerline of the peripheral surface of each cutting disc. Into each such tapped hole, a flat, Allen head cap screw would be threaded so that a substantial portion of the screw projected outwardly of the disc surface. Such screw-type lugs or teeth would be more readily insertable into and removable from the discs 23 than the teeth 52.

Operation

In normal operation of the shredder, referring to FIGS. 1–8, grinding wheel 132 is withdrawn from engagement with cutting discs 23 of the associated shredding drum. The infeed teeth or lugs 52 are in place on the cutting discs.

Lugged infeed conveyor 106 conveys one tire T at a time upwardly from storage magazine 126 to infeed hopper 98, discharging such tire vertically into the hopper. The hopper guides the tire vertically downwardly into the bight 58 between the counterrotating drums 10, 12, which rotate inwardly and downwardly at the upper infeed side of such drums. Infeed teeth 52 force the tire down between the opposed coacting cutting discs 23 which shear the tire into strips which pass downwardly between the drums and drop onto slowly rotating screening drum 66.

The carrier partition 78 of the screening drum lift the rubber strips upwardly toward the infeed side of the shredding drum assembly. Fixed shield wall 94 retains the strips within the screening drum trough as they move generally vertically upwardly and then approach infeed hopper 98 on the infeed side of the shredding drum assembly. As a trough section of the screening drum containing the strips approaches a position over infeed hopper 98, the strips pass beyond shield wall 94, dropping from the screening drum into the infeed hopper, which guides such strips back into bight 58 between the shredding drums for reshredding by the cutting discs.

The reshredded pieces, now much smaller than before, again pass downwardly through the shredding drums and drop back onto the foraminous outer wall of the screening drum. Those reshredded pieces smaller than the openings of such screening wall pass through such wall and onto discharge conveyor 68 for removal to a storage site.

As the reshredding process continues, additional whole tires are carried one at a time upwardly on tire infeed conveyor 106 and discharged into the infeed hopper 98 for shredding. The deposit of each tire into hopper 98 is preferably alternated with the dumping of a load of scraps for reshredding from the screening drum into such hopper, although feeding of whole tires and scrap chips can occur simultaneously with proper adjustment of the screen and infeed conveyor speeds so as to not overload the shredding drums.

When the cutting edges 48, 49 of cutting discs 23 are in need of resharpening, the infeed teeth or lugs 52 are first removed from the cutting discs. This is done simply and quickly first by removing roll pins 54 from their associated infeed teeth and then lifting the teeth from their recesses. Then with the drums counterrotating in their usual manner, the grinding wheels 132 are rotated and at the same time moved linearly toward the cutting discs by turning the hand wheel 140 until the desired grinding contact with the outer surfaces of the discs is made. It will be apparent that all cutting discs of drum 10 are ground simultaneously and to the same extent by the grinding wheel segments 132.

After the cutting discs are reground, the grinding wheel segments are withdrawn from the discs by turning hand wheel 140 in the appropriate direction. Then the roll pins are inserted back into their respective infeed teeth and the teeth reinserted into their appropriate slots and tapped downwardly and rearwardly therein until roll pins 54 wedge them securely in place. The shredding drums are now ready for shredding additional material.

Although the shredding apparatus has been described with reference to the shredding of rubber tires and the reshredding of tire strips or chips, it will be apparent that the apparatus generally as described would also be appropriate for shredding other bulk scrap rubber and other scrap materials in a highly efficient manner. Also by changing the size of the screening drum openings and spacing between tines, the size range of particles produced by the shredding apparatus can be controlled and varied.

Having illustrated and described the principles of our invention with reference to a presently preferred embodiment and several possible alternatives, it should be apparent to those skilled in the art that the invention may be modified in arrangement and detail without departing from such principles. We claim as our invention all such modifications, whether specifically disclosed or not, as come within the true spirit and scope of the following claims.

We claim:

1. A shredding apparatus comprising:

a pair of side-by-side parallel and generally cylindrical shredding drums, each said drum defining a series of axially spaced-apart cutting discs, said drums being rotatably mounted with respect to one another such that upon rotation the discs of said opposed drums coact to shred scrap material fed into the bight between said drums, drive means for counterrotating said drums so that said drums have an infeed side and an outfeed side, and a screening conveyor means for receiving shredded scrap pieces discharged from between said drums on said outfeed side and conveying large ones of said pieces to said infeed side for reshredding into smaller pieces while passing smaller pieces therethrough, said screening conveyor means comprising a rotatable screening drum means encircling said shredding drums and drive means for rotating said screening drum means at a slow rate of speed whereby the effect of centrifugal force in retaining material on said screening drum means is minimized, said screening drum means having a foraminous cylindrical outer wall and annular opposed sidewalls which together define a continuous annular trough means for retaining shredded scrap materials, said trough means being open along its inner circumference, said annular trough means being subdivided annularly into a series of trough sections by transverse carrier means for lifting material upwardly toward the infeed side of said drums within said trough means upon rotation of said screening drum, said carrier means comprising a series of foraminous transverse partition means extending between opposite sidewalls of said annular trough means, whereby a tumbling and screening action is achieved because of the slow rotational speed of said screening drum, stationary shield wall means positioned closely adjacent to and spanning the open inner circumference of said trough means at least along the substantially vertically upwardly traveling portions of said screening drum means for retention of scrap materials within said trough sections until carried upwardly to the infeed side of said shredding drums.

2. Apparatus according to claim 1 wherein said foraminous partition means comprise grating structures.

3. A shredding apparatus according to claim 1 including infeed conveyor means for conveying bulk raw scrap material to the infeed side of said shredding drums for shredding, and drive means for said screening conveyor means and said infeed conveyor means, at least one of said drive means comprising a variable speed drive for correlating the operation of said infeed conveyor means with the operation of said screening conveyor means such that bulk raw scrap material can be discharged to the infeed side of said shredding drums alternately with the discharge of shredded scrap for reshredding to said infeed side by said screening conveyor means.

4. Apparatus according to claim 1 including drive means for said screening drum, said drive means including opposed pairs of drive wheel means frictionally engaging and rotatably supporting lower portions of the outer circumferential surface of said screening drum, and means for rotating all of said drive wheel means in the same rotational direction such that the frictional engagement of said drive wheel means with said screening drum and rotation of said drive wheel means rotates said screening drum about its central axis.

5. Apparatus according to claim 1 wherein said drive means for said screening drum includes means for varying the rotational speed of said screening drum.

6. A shredding apparatus according to claim 1 including infeed conveyor means for conveying bulk raw scrap material to the infeed side of said shredding drums for shredding, said infeed conveyor means comprising a lugged endless conveyor means for conveying rubber tires singly and at spaced intervals from a stack of said tires to the infeed side of said shredding drums, said stack of tires being positioned in a magazine positioned at an infeed end of said lugged endless conveyor means overlying an upwardly traveling end run of said endless conveyor means, said lugged endless conveyor means including a series of lugs spaced apart along said endless conveyor means, each of said lugs being operable upon traveling about said upwardly traveling end run onto an upper run thereof to enter the center opening of the lowermost tire in said stack and thereby engage said lowermost tire and drag the same from stack onto said upper run to convey said tire to the infeed side of said shredding drums.

7. A shredding apparatus according to claim 6 including variable speed control means for controlling and correlating the speeds of said screening drum means and infeed conveyor means such that bulk raw scrap material can be discharged to the infeed side of said shredding drums alternately with the discharge of oversized shredded scrap for reshredding to said infeed side.

8. Apparatus according to claim 7 wherein said screening drum means is rotated at speeds so as to move said outer foraminous wall at speeds in the range of about 50 to 480 lineal feet per minute.

9. Apparatus according to claim 8 wherein said infeed conveyor means is operated at speeds in the range of about 0 to 85 per minute.

10. A shredding apparatus comprising:

a pair of side-by-side parallel and generally cylindrical shredding drums, each said drum defining a series of axially spaced-apart cutting discs, said drums being rotatably mounted with respect to one another such that upon rotation the discs of said opposed drums coact to shred scrap material fed into the bight between said drums, drive means for counterrotating said drums so that said drums have an infeed side and an outfeed side, and a screening conveyor means for receiving shredded scrap pieces discharged from between said drums on said outfeed side and conveying large ones of said pieces to said infeed side for reshredding into smaller pieces while passing smaller pieces therethrough, said screening conveyor means comprising a rotatable screening drum means encircling said shredding drums, said screening drum means having a foraminous cylindrical outer wall and annular opposed sidewalls which together define a continuous annular trough means for retaining shredded scrap materials, said trough means being open along its inner circumference, said annular trough means being subdivided annularly into a series of trough sections by transverse carrier means for lifting material upwardly toward the infeed side of said drums within said trough means upon rotation of said screening drum, said carrier means being of rake-like construction, with each said carrier means including multiple tines spaced across the width of said trough means and extending inwardly of the foraminous outer wall of said screening drum means, the spacing between said tines of each said carrier means corresponding substantially to the maximum size of the openings in said foraminous outer wall, the tines of each carrier means being parallel to each other, the radial angle defined by the tines of circumferentially adjacent carrier means differing from one another, whereby each successive carrier means delivers scrap material to a different portion of said infeed side along the length of said shredding drums.

11. Apparatus according to claim 10 wherein said foraminous outer wall has openings therethrough in a size range of from two to four inches and said tine spacing is also within said range.

12. Apparatus according to claim 10 including stationary shield wall means positioned closely adjacent to and spanning the open inner circumference of said trough means at least along the substantially vertically upwardly traveling portions of said screening drum means for retention of scrap materials within said trough sections until carried upwardly to the infeed side of said shredding drums.

13. Apparatus according to claim 10 including variable speed drive means operable to rotate said screening drum about its central axis so as to move said outer foraminous wall at speeds in the range of from about 50 to 480 lineal feet per minute.

14. Apparatus according to claim 10 including stationary shield wall means positioned closely adjacent to and spanning the open inner circumference of said trough means at least along the substantially vertically upwardly traveling portions of said screening drum means for retention of scrap materials within said trough sections until carried upwardly to the infeed side of said shredding drums.

15. Apparatus according to claim 12 including variable speed drive means operable to rotate said screening drum about its central axis so as to move said outer foraminous wall at speeds in the range of from about 50 to 480 lineal feet per minute.

16. A shredding apparatus comprising:

a pair of side-by-side parallel and generally cylindrical shredding drums, each said drum defining a series of axially spaced-apart cutting discs, said drums being rotatably mounted with respect to one another such that upon rotation the discs of said opposed drums coact to shred scrap material fed into the bight between said drums, drive means for counterrotating said drums so that said drums have an infeed side and an outfeed side, and a screening conveyor means for receiving shredded scrap pieces discharged from between said drums on said outfeed side and conveying large ones of said pieces to said infeed side for reshredding into smaller pieces while passing smaller pieces therethrough, said screening conveyor means comprising a rotatable screening drum means encircling said shredding drums, said screening drum means having a foraminous cylindrical outer wall and annular opposed sidewalls which together define a continuous annular trough means for retaining shredded scrap materials, said trough means being open along its inner circumference, said annular trough means being subdivided annularly into a series of trough sections by transverse carrier means for lifting material upwardly toward the infeed side of said drums within said trough means upon rotation of said screening drum, each said carrier means being of rake-like construction and including multiple parallel tines spaced across the width of said trough means and extending inwardly of said foraminous outer wall, the radial angle defined by the tines of circumferentially adjacent carrier means differing from one another whereby each successive carrier means delivers scrap material to a different portion of said infeed side lengthwise of said shredding drums.

17. Apparatus according to claim 16 wherein said radial angle of successive carrier means varies within a range of about 0° to 45°, stationary shield wall means positioned closely adjacent to and spanning the open inner circumference of said trough means at least along the substantially vertically upwardly traveling portions of said screening drum means for retention of scrap materials within said trough sections until carried upwardly to the infeed side of said shredding drums, and variable speed drive means operable to rotate said screening drum about its central axis so as to move said outer foraminous wall at speeds in the range of from about 50 to 480 lineal feet per minute.

18. Apparatus according to claim 16 wherein said radial angle of successive carrier means varies within a range of about 0° to 45°.

19. Apparatus according to claim 18 wherein said radial angle of successive carrier means increases progressively within said range in increments of about 15°.

* * * * *